United States Patent [19]

Fujita et al.

[11] 3,973,426

[45] Aug. 10, 1976

[54] METHOD OF COOLING STEEL WIRE

[75] Inventors: Tatsu Fujita; Heijiro Kawakami, both of Kobe; Yoshiro Yamada, Akashi; Tetsuo Yamada, Kobe, all of Japan

[73] Assignee: Kobe Steel Limited, Kobe, Japan

[22] Filed: June 24, 1974

[21] Appl. No.: 482,578

[30] Foreign Application Priority Data

June 23, 1973 Japan ..... 48-70941

[52] U.S. Cl. ..... 72/286

[51] Int. Cl.[2] ..... B21C 9/00

[58] Field of Search ..... 72/44, 45, 286, 342, 72/467; 148/12

[56] References Cited

UNITED STATES PATENTS

| | | | |
|---|---|---|---|
| 2,119,516 | 6/1938 | Schuster | 72/286 |
| 2,161,570 | 6/1939 | Harris | 72/342 |
| 2,203,751 | 6/1940 | Simons | 72/45 |
| 2,206,977 | 7/1940 | Seeley | 72/467 |
| 2,252,365 | 8/1941 | Fisher | 72/45 |
| 2,257,644 | 9/1941 | Pierce | 72/286 |
| 2,325,342 | 7/1943 | Pursel | 72/286 |
| 2,924,329 | 2/1960 | Compson | 72/342 |
| 2,974,778 | 3/1961 | Ellis et al. | 72/286 |
| 3,562,115 | 9/1970 | Armstrong et al. | 72/45 |
| 3,774,436 | 11/1973 | Tviksta | 72/342 |
| R20,067 | 8/1936 | Busey | 72/467 |

FOREIGN PATENTS OR APPLICATIONS

| | | |
|---|---|---|
| 30-6429 | 10/1930 | Japan |
| 1,249,926 | 10/1971 | United Kingdom |

*Primary Examiner*—Milton S. Mehr

*Attorney, Agent, or Firm*—Oblon, Fisher, Spivak, McClelland & Maier

[57] ABSTRACT

A method for cooling a steel wire which is being drawn in a dry lubricant wire drawing operation wherein the rear portion of the die, including the backrelief portion thereof and the wire which has just been drawn to the desired dimension, are brought into direct contact with a cooling medium so as to effect forced cooling thereof, the wire thereby being cooled before the commencement of strain-aging embrittlement within the wire.

19 Claims, 19 Drawing Figures

FIG. 6a
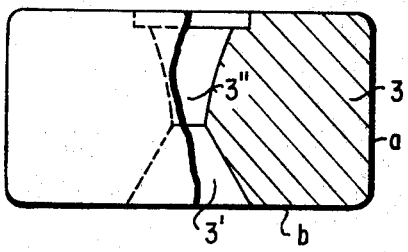
FIG. 6b
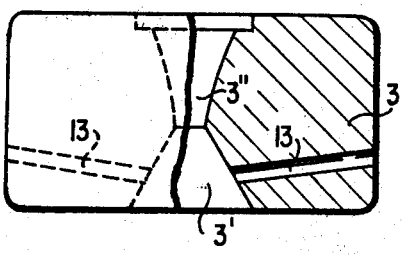
FIG. 7a
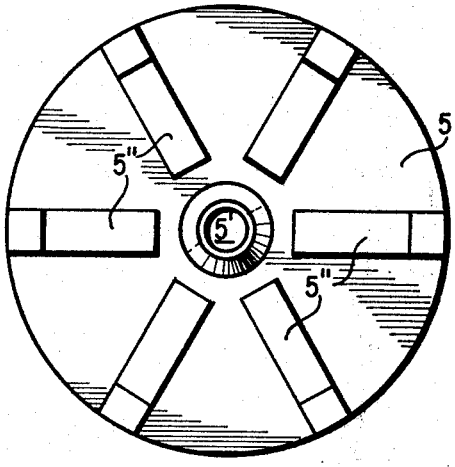
FIG. 7b
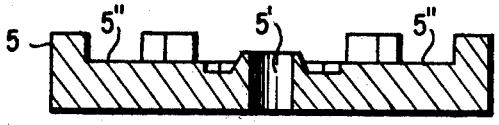
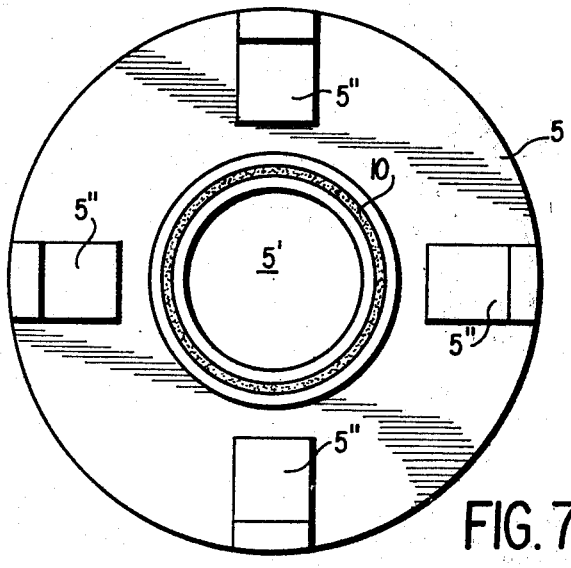
FIG. 7c
FIG. 7d
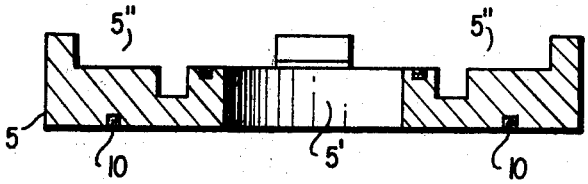

METHOD OF COOLING STEEL WIRE

BACKGROUND OF THE INVENTION

1. Field of the Invention:

The present invention relates generally to a method for cooling a wire which is being subjected to a drawing process, and more particularly to a method for cooling a wire which has undergone dry-drawing, wherein the rear portion of the die and the wire which has just been drawn to the desired dimension and which is conducted through the downstream region of the die exit are brought into direct contact with a cooling medium whereby the wire is forcedly cooled prior to the commencement or occurrence of strain-aging embrittlement within the wire.

2. Description of the Prior Art:

Heretofore, undesirable strain-aging embrittlement has occurred within, for example, steel wires which have undergone dry-drawing, and more particularly within high strength steel wires, due to the excessive temperature characteristic of the wire when drawn. It is thus desirable to reduce or eliminate such a temperature rise to a maximum extent, such as for example, by reducing the drawing speed of the wire, whereby the occurrance of surface cracking or the rupture of the wire due to the strain-aging embrittlement is prevented. In connection with such, one attempt for so eliminating aging embrittlement is known and is disclosed within British Pat. No. 1249926, such method comprising water-cooling of the wire when the same is on the rotatable drawing block. This method however has proven to be an insufficient solution to the aforenoted problems.

Another attempt is disclosed within the Japanese Utility Model Publication No. 3437/1955, wherein there is provided cooling apparatus for the wire which is to be utilized during the drawing step, wherein cooling is impressed upon the wire at a predetermined time subsequent to the drawing thereof. In addition, further attempts, as disclosed within Japanese Utility Model Publication No. 3438/1955 and Japanese Utility Model Publication No. 6429/1955, deal with air cooling apparatus for wires wherein cooling is likewise impressed upon the wires at a predetermined time subsequent to drawing. As a result, the undesirable and deleterious strain-aging embrittlement within the wire still occurs and remains unresolved.

Applicants have conducted extensive studies of dry-drawing processes of steel wires, particularly in an attempt to prevent the strain-aging embrittlement of wires, and as a result, have made the discovery that the mere water and/or air cooling of the wires, as has been suggested within the prior art, is not in fact a sufficient solution to this problem and moreover, that the temperature of the wire at the moment the wire has just been reduced to the desired dimension largely affects the aforesaid strain-aging embrittlement. Consequently, a sharp reduction or decrease in the temperature of the wire immediately subsequent to the emergence of the wire from the die is necessary in order to solve the aforenoted problems.

Continuing further, other prior art methods of drawing steel wire have also been proposed, such as for example, a wet drawing system, wherein the die is immersed within a cooling medium. These methods however are particularly applicable to the drawing of wire having a gauge less than 1 mm in diameter or when a gloss upon its surface is required. In one such method, a water-soluble or oily lubricant is used as the cooling medium, however this method suffers from the disadvantage that insufficient lubrication is normally present whereby overheating of the wire occurs which deteriorates the surface finish and the ductility thereof.

The prior art dry drawing processes, the improvement of which is the subject of the present invention, utilizes a solid lubricant, such as for example, solid powder soap, however due to the nature of production, there has not been proposed any method of forcedly cooling wire immediately subsequent to the emergence of the same from the die. Dry drawing of a steel wire is superior in lubrication, as well as in operational environment and drawing efficiency to the wet drawing thereof, however the processes are entirely different when comparing the same in order to devise solutions to particular problems characteristic of one or the other processes.

SUMMARY OF THE INVENTION

Accordingly it is an object of the present invention to provide a method for cooling a steel wire wherein cooling is impressed upon the drawn wire immediately subsequent to, or simultaneously with, the emergence of the wire from the die so as to thereby prevent the occurrence of strain-aging embrittlement of the wire due to the temperature rise accompanying the drawing process of the wire.

Another object of the present invention is to provide a method for cooling a steel wire during drawing, wherein the surface of the wire being drawn is cooled as rapidly as possible.

Still another object of the present invention is to provide a method for cooling a steel wire during drawing, wherein the temperature of the wire is lowered as far as is possible.

Yet another object of the present invention is to provide a method for cooling a steel wire during drawing, wherein the die provided within the drawing apparatus is cooled simultaneously with the steel wire being drawn.

The foregoing and other objectives are achieved according to a first aspect of the present invention wherein there is provided a method for cooling a steel wire, and a die, wherein more particularly, both the rear portion of the die, including the backrelief portion thereof, and a wire drawn to a desired dimension are immediately brought into direct contact with a cooling medium whereby the wire is cooled prior to the commencement of strain-aging embrittlement of the wire.

According to a second aspect of the present invention, there is provided a method for cooling a steel wire during drawing wherein a cooling liquid passage is provided within the rear portion of the die.

According to a third aspect of the present invention, there is provided a method for cooling a steel wire wherein the cooling liquid passage is provided within the forward portion, as well as a peripheral surface portion, of the die, in addition to the provision of such within the rear portion of the die as provided in accordance with the second aspect of the present invention.

According to a fourth aspect of the present invention, there is also provided a method for cooling a steel wire wherein, in conjunction with the cooling passages provided in accordance with the second or third aspects of the present invention, a cooling liquid passage is provided so as to extend from the exit portion of the die holder through a pipe or conduit encompassing the steel wire along the longitudinal extent thereof.

According to a fifth aspect of the present invention, there is provided a method for cooling a steel wire wherein the cooling liquid passage extends through the pipe or conduit as set forth in accordance with the fourth aspect of the present invention and is bounded by the backrelief portion of the die.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts throughout the several views, and wherein:

FIGS. 6*a* and 6*b* are vertical longitudinal cross-sectional views of a die constructed according to the present invention;

FIGS. 7*a*, 7*c* and 7*b*, 7*d* are plan views and transverse cross-sectional views of cooling water guide fixtures utilized in conjunction with the rear and front portions of the die;

DETAILED DESCRIPTION OF THE PREFERRED EMBODIMENTS

Figure 1:
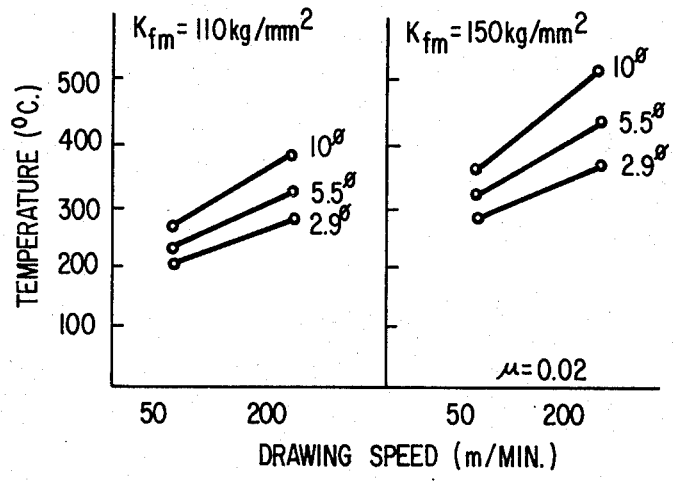
FIG. 1 is a graphical plot showing the rise in temperature in accordance with the drawing speed of steel wires of different deformation resistances.

As has been described earlier, the present invention is directed to preventing the occurrence of strain-aging embrittlement within a drawn wire, caused as a result of a temperature rise within the wire effected during the drawing process, by applying forced cooling to the wire immediately subsequent to the emergence of the wire from the die, that is, at the moment the wire has been drawn to the desired dimension and thus has just emerged from the die, the wire thereby being cooled before the commencement of strainaging embrittlement within the wire. More particularly, a considerable proportion of the work energy expended in drawing a metal or alloy wire through a die is converted into heat which of course contributes to a substantial rise in the temperature of the wire. This is particularly true in the case of a high strength wire, such as for example, a high carbon steel wire, and this phenomenon exerts adverse effects upon the properties of the wire drawn.

To further comprehend the factors related to this temperature rise, the inventors have closely studied the quantitative change in temperature distribution within a steel wire immediately subsequent to the emergence of the same from the die exit as a function of time and under varying cooling conditions. The work energy expended in deforming a steel wire upon passing the same through a die is responsible for the temperature rise within the wire, and such work may be classified into pure deforming work, shearing work, and frictional work components along the interface between the die and the surface of the steel wire being drawn, the pure deforming work being uniformly accomplished throughout the steel wire while the remaining two work components, particularly the frictional work, is evident within the surface layer of the steel wire. For this reason, the temperature at the central portion of the wire upon exiting from the die is lowest while that at the surface layer of the wire is highest.

According to calculations disclosed within a publication entitled "BILDSAME FORMUNG DER METALLE IN RECHNUNG UND VERSUCH:", By Alexander Geleji, and Translated by Isao Gokyu, the temperature at the central portion of the steel wire is approximately 100°C while the temperature within the surface layer thereof may be within the range of from 200°C to 450°C. The greater the strength of the steel wire and hence the greater the deformation resistance, and/or, the higher the percentage reduction of area, the larger will be the temperature rise. On the other hand, the temperature rise at the surface layer of the wire is proportional to the coefficient of friction between the die and the steel wire, and the greater the diameter of the wire drawn, the larger the temperature rise, in terms of a constant or similar reduction in area.

Assuming for example an average deformation resistance of 110 kg.mm$^2$, a half die angle of 6°, the coefficient of friction $\mu = 0.06$, the diameter of a wire being $5.37\phi \rightarrow 4.90\phi$ (percentage reduction of area being 17%) and a drawing speed of 100 m/min., the temperature at the central portion of the wire will be between 50°C and 80°C, while the temperature at the surface of the wire will be approximately 350°C, the temperature at the surface of the wire being largely dependent upon the coefficient of friction. For example, in conjunction with the above, assuming that $\mu = 0.02$, then the temperature at the surface of the wire will be between 200°C and 250°C. Similarly, the temperature at the surface of the wire may be as high as 370°C even if $\mu = 0.02$ if the drawing speed of the wire is so selected. Thus, it may be concluded that temperature increases as large as have been exemplarily shown are likely to be characteristic of wire drawing processes for high tensile strength steel wires.

Referring now to FIG. 1, there is shown plots of the estimated or calculated temperatures at the surface of the wires being drawn. Within wire drawing apparatus and particularly in the instance of drawing processes performed upon continuous wire drawing machines, heat is gradually accumulated within the wire as it proceeds toward final drawing step, that is, the temperature of the drawn wire is equal to the sum of the temperature rise due to the heat generated as a result of the deformation of drawing and the temperature of the wire prior to entering the die with respect to each drawing step.

Accordingly, it may be quite reasonable to assume that the temperature at the surface of the wire will be as high as 370°C and the temperature at the center thereof will be as high as 100°C.

The temperature changes within the central portion of the surface layer of the wire, relative to the time lapse, were obtained assuming that when the wire has just been drawn, the temperature at the central portion thereof was 100°C and that at the surface layer was 370°C and further assuming that the temperature distribution within the wire at the exit of the die follows a parabolic pattern for simplifying the calculations. In conjunction with such calculations, the room temperature is assumed to be 20°C, in the instance of air cooling and the temperature of the water is 20°C in the instance of water spray cooling, and the coefficients of heat transfer for the steel wire when disposed within the cooling medium are assumed to be 20 kcal/m²h°C and 20,000 kcal/m²h°C, respectively, the results being shown within FIGS. 2 and 3 for air cooling and water spray cooling respectively.

Figure 2:
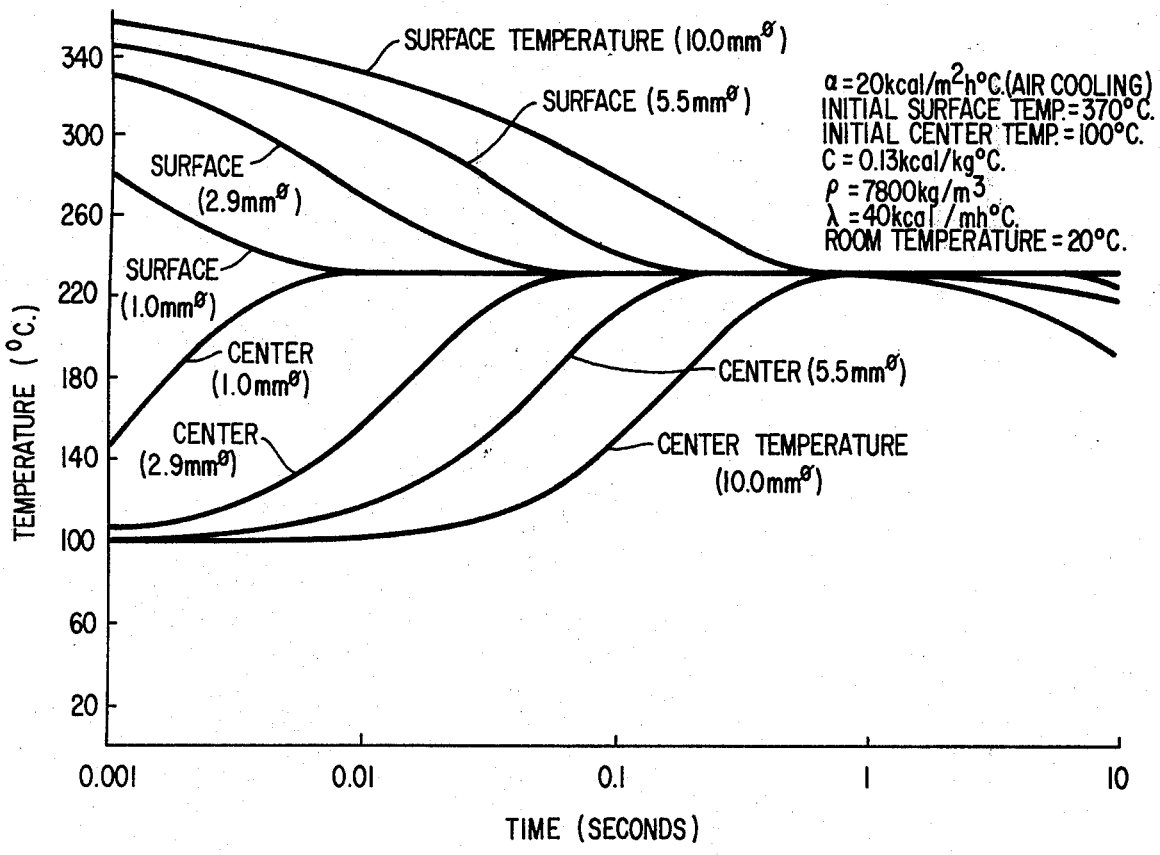
FIG. 2 is a graphical plot showing the temperature changes relative to time lapse periods, within the surface and central portions of the steel wire immediately subsequent to drawing and under the influence of air cooling.

In the instance of air cooling, with particular reference to FIG. 2, there results a temperature drop of as much as several scores of degrees for a time period as short as 0.001 second, as measured at the surface layer of wires having relatively small diameters, such as for example, 1.0 mm or 2.9 mm, wherein the point of measurement is located 2 mm from the end of the die-deformation zone, that is, from the die exit, and wherein further the speed of the wire being drawn was 120 m/min. In this respect, heat prevailing at the surface layer of the steel wire initially diffuses into the interior portion of the wire whereby the central portion thereof will then be heated resulting in a uniform temperature distribution throughout the cross section of the wire followed by heat transfer to the atmosphere.

Figure 3:
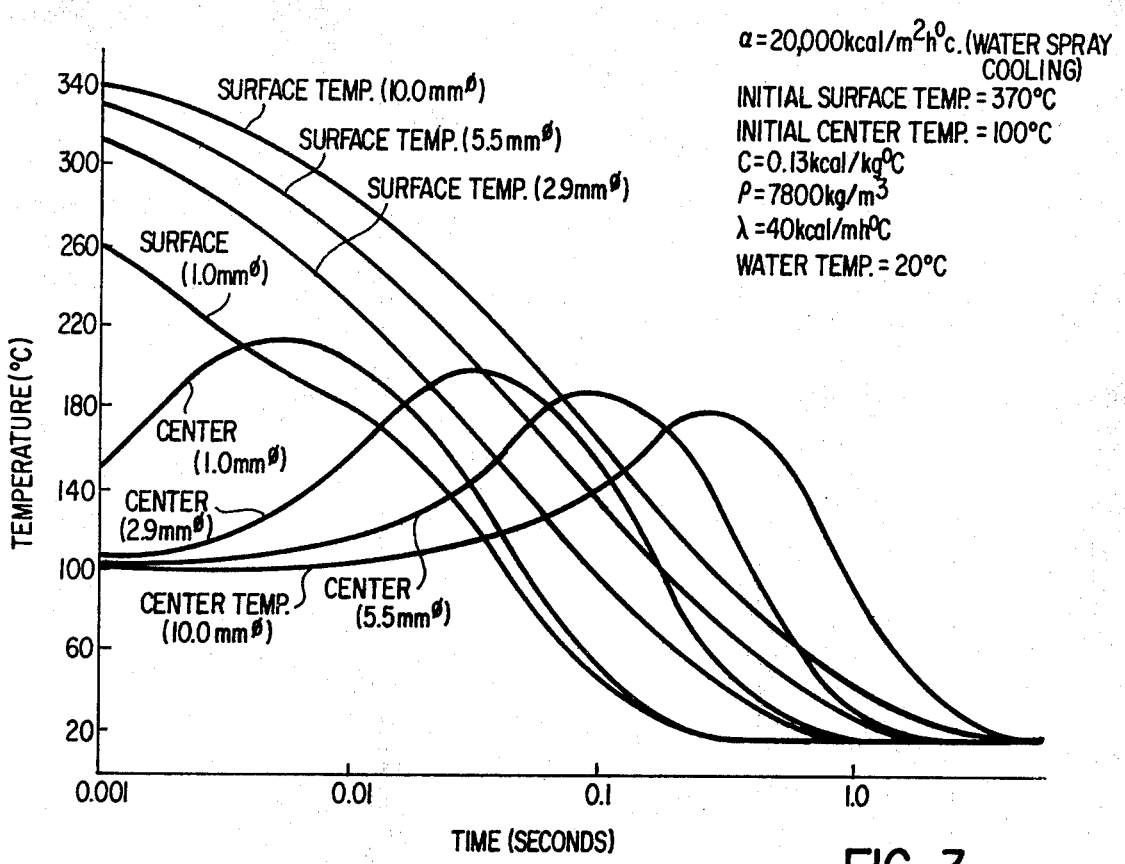
FIG. 3 is a graphical plot similar to that of FIG. 2, showing however the various parameters as a result of water spray cooling.

To the contrary, in the instance of water spray cooling, with particular reference to FIG. 3, wherein the wire is cooled from a position immediately rearwardly or downstream of the die exit, there will result a very rapid and considerable temperature drop at the surface layer of the wire, the heat at the surface layer of the wire being transferred to the atmosphere initially. Consequently, the heat to be diffused into the interior portion of the wire will be less whereby a resultant lower temperature within the central portion of the wire and cooling to such lower temperature may be achieved within a short period of time. For example, if water is continuously sprayed upon the wire at a position immediately rearwardly or downstream of the die exit for a time period of one second, then the temperature at the wire will be lowered to room temperature within such time duration, and it has been noted that the aforenoted difference between air cooling and water spray cooling will be maintained even if the initial temperature of the wire is varied.

As has been described hereinabove, it is thus apparent how the temperature within a drawn steel wire is affected, as a function of time, by the cooling conditions. A description will now be given of how strain-aging occurs in accordance with such temperature changes within a steel wire and as a function of time. The strain rate of a steel wire due to deformation through a die in an ordinary wire drawing operation is approximately $10^2$/sec, and in view of such a strain rate, dynamic strain aging will not occur unless the temperature of the wire exceeds 450°C, the term "dynamic aging" being defined as that which is caused by the interaction between the dislocations contributing to the deformation and the solute atoms.

Furthermore, it may be safe to assume that temperatures above 450°C within a steel wire during an ordinary drawing operation seldom prevails so that the discussion will hereinafter be limited merely to static strain-aging, the term, "static strain-aging" being defined as that which occurs when a wire experiences no plastic deformation, although it should of course be noted that the present invention may be effectively applied even to the case of dynamic strain aging since the wire temperature in the die can be lowered in accordance with the superior die cooling. Static strain-aging occurring at the time of drawing will proceed under a drawing force applied to a wire, however, this force is less than the yield stress and therefore merely enhances the strain aging to a limited extent. Thus, the static aging mechanism, under no external load conditions, may be directly applied to this case.

Figure 4:
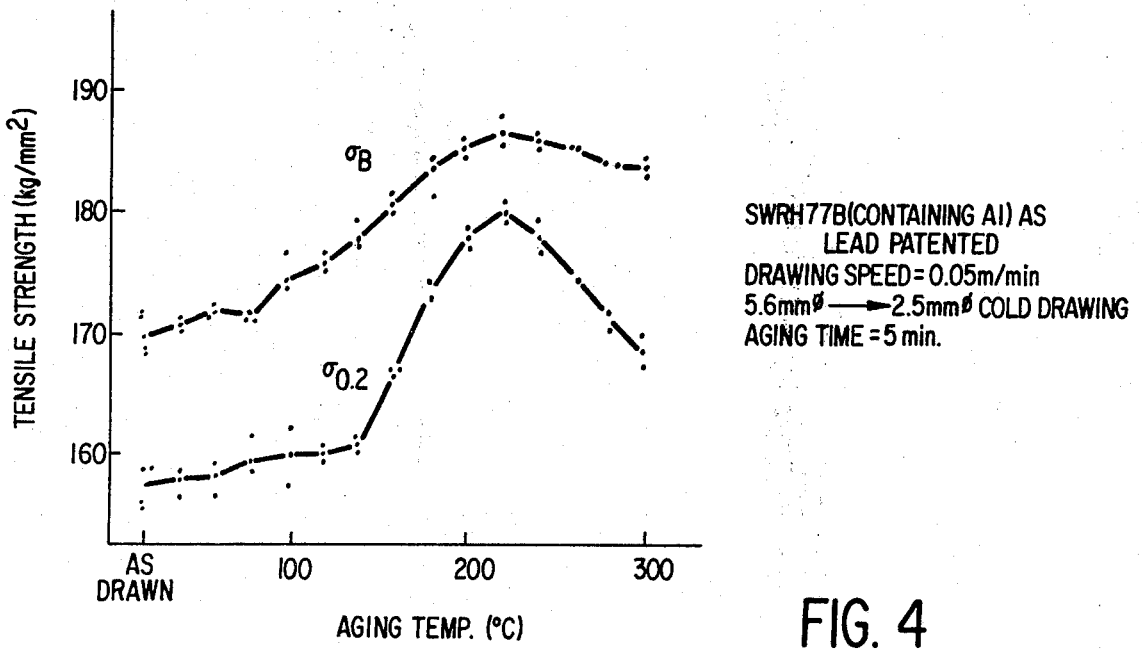
FIG. 4 is a graphical plot showing the relationship between the aging temperature of a steel wire and the resulting tensile stress.

Continuing further and more particularly with respect to an example, a commercially available high carbon steel wire SWRH77B, containing 0.06% aluminum, which had been manufactured at a very low drawing speed, the temperature of the wire being maintained below 40°C, was strain-aged at temperatures within the range of from 40°C to 300°C for a time period of 5 minutes, followed by tensile tests at room temperature, FIG. 4 showing the tensile strengths as a function of aging temperature. As is apparent therefrom, no significant increase in the yield strength occurs at temperatures below 150°C. Similarly, the reduction of area obtained exhibits no appreciable decrease when aged at temperatures below 150°C although the reduction of area does exhibit a sharp decrease at temperatures exceeding the above temperature, with the reduction of area remaining unrecovered even if subjected to over-aging at temperatures above the range between 200°C and 250°C at which the highest tensile strength is obtained. The reduction of area in fact shows improvements only when aged at a temperature exceeding 450°C, and accordingly, the prevention of embrittlement within a steel wire due to aging requires the temperature thereof to be so maintained below that at which the condition wherein the tensile strength increases sharply occurs.

Figure 5:
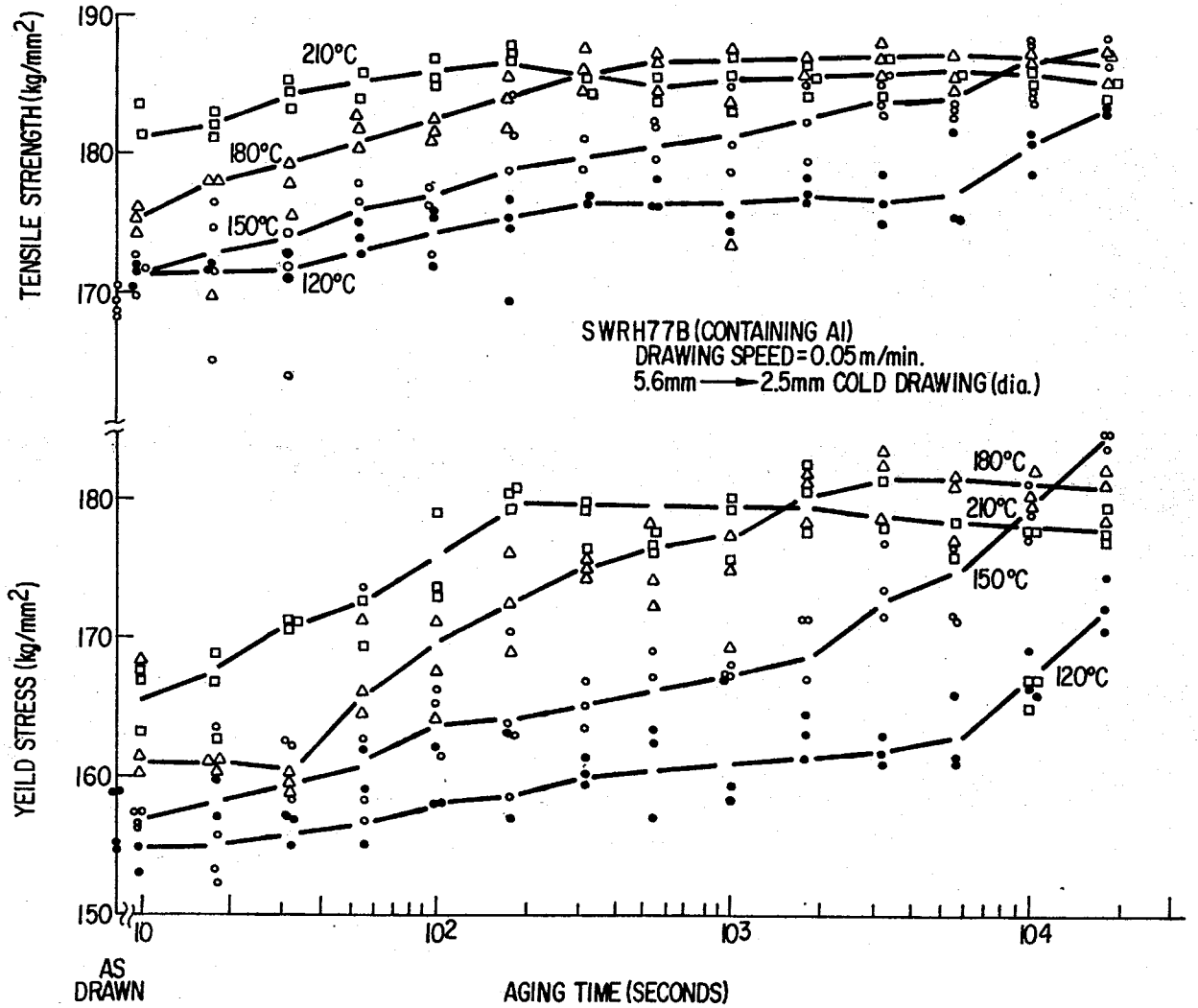
FIG. 5 is a graphical plot showing the relationship between the aging time for a steel wire, the yield stress, and the tensile strength thereof.

With particular reference now being made to FIG. 5, the results of tests performed in order to clarify the relationship between the temperature associated with the aforenoted sharp increase in tensile strength as a function of time, are shown. The relationship between the isothermal aging and the tensile strength at room temperature within a material equivalent to SWRH77B, containing 0.06% aluminum, lead patented and cold drawn at a drawing speed of 0.05 m/min. illustrates the fact that aging proceeds for a short time due to the increase in temperature, from 120°C to 210°C, and that the aging embrittlement proceeds progressively due to such an increase in temperature, Table 1 further illustrating the relationship between the time, commencing with the starting point of the sharp increase in tensile strength and the temperatures, in the case of isothermal aging.

Table 1. Relationship between the time commencing with the starting point of the sharp increase in tensile strength and temperature (isothermal aging)

| TEMPERATURE (°C) | TIME (SECOND) |
|---|---|
| 100 | $7 \times 10^3$ |
| 120 | $2.2 \times 10^3$ |
| 140 | $3.2 \times 10^2$ |
| 160 | 80 |
| 180 | 20 – 30 |
| 200 | 4.2 |
| 220 | 1.5 |
| 240 | 0.5 |
| 260 | 0.2 |
| 280 | 0.08 |

Note:
Sample = 1.8$\phi$ → 1.0$\phi$ drawn wire, 0.81C – 0.016 Si, 0.0005 Mn

As is apparent from FIGS. 4 and 5 and Table 1, in order to avoid strain aging of a steel wire within a drawing operation, the time during which the steel wire is maintained at a temperature between 200°C to 300°C or above should be shortened, and the temperature of the steel wire lowered to a level at which strain aging would not occur, prior to the commencement of strain aging. Accordingly, if the time during which the steel wire is maintained at a high temperature is long enough to permit strain aging to occur, satisfactory results will not be achieved even if the cooling rate is increased after the temperature of the wire has been lowered to the range of 200°C to 300°C.

The following conclusions may thus be derived as a result of the temperature changes of the steel wire, relative to the time lapse, as typified within FIGS. 2 and 3 as well as from the occurrence of strain aging within the wire drawing process as represented by FIGS. 4 and 5 and Table 1, that is, according to the method of cooling a drawn wire after drawing, as shown in FIG. 2 wherein the temperature of the steel wire is maintained above 200°C even after a time lapse of one second after the steel wire has emerged from the die, strain aging will be commenced during such time thus causing embrittlement within the wire. Similarly, according to the prior art water-cooling method wherein the wire is cooled in the course of being transported to a rotating drawing block and the timing of the commencement of water cooling is approximately 0.1 second or longer after the wire emerges from the die, the speed of the wire being drawn being assumed to be 120 m/min, as has been described earlier, it follows that as cooling is applied after the commencement of strain aging, there will result a failure to obtain satisfactory mechanical properties. To the contrary however, according to the method of forced cooling and water spray cooling from the immediately rearwardly or downstream position relative to the die exit, the surface temperature of the steel wire is decreased below 300°C, that is, the temperature at the central portion of the wire is below 300°C, within 0.01 second after the egress of the wire from the die, even in the instance of a heavy gauge wire, whereby there is no possibility of strain aging being caused as a result of the cooling of the wire to a substantially low temperature within a short period of time.

Employable as a cooling medium within the present invention, according to which there is forced cooling of the steel wire immediately rearwardly or downstream of the die exit, the results of which are shown in FIG. 3, is, for example, water having a temperature below 50°C or other suitable liquids having a desired cooling capability, the temperature of the cooling medium preferably being well below its boiling point. In the instance of the use of water as the cooling medium within water spray cooling, the influence due to changes in the water pressure, the quantity of the water supplied, and the relative speed of the water supplied to the steel wire are not materially great, the maximum flow rate of the water being set for example to 0.1 $m^3$/min, and preferably 0.01 $m^3$/min, for each die. As can be seen from FIG. 5 and Table 1, if the temperature of the steel wire is below 150°C, strain aging will not proceed, and therefore, the forced cooling should preferably be applied to the wire, until the same has been cooled to 150° C. In the instance of a steel wire having a diameter of less than 13 $\phi$, the decrease in the temperature of such wire requires a time duration of only 0.01 – 1 second for water cooling, wherein the temperature of the water is approximately 25°C, it being apparent that the smaller the diameter of the wire, the shorter the cooling time required.

The temperature rise at the die itself is attributable to the heat generated as a result of the friction prevailing between the steel wire and the die as well as the heat transmitted from the wire to the die. Prior attempts of cooling the die have proven unsatisfactory in preventing a substantial temperature rise thereof as such methods resort to conventional cooling processes whereby only the outer peripheral surface of the die is subjected to the cooling liquid. The highest temperature within the die exists along the bearing portion thereof where the final reduction in area of the steel wire drawn is performed. In view of such, the present invention contemplates the direct, forced cooling of the back relief portion of the die including the area within the vicinity of the die exit so as to thereby remove the heat as satisfactorily as possible from the die which of course also results in the lowering of the maximum temperature of the wire surface itself within the die bore.

Figure 9:
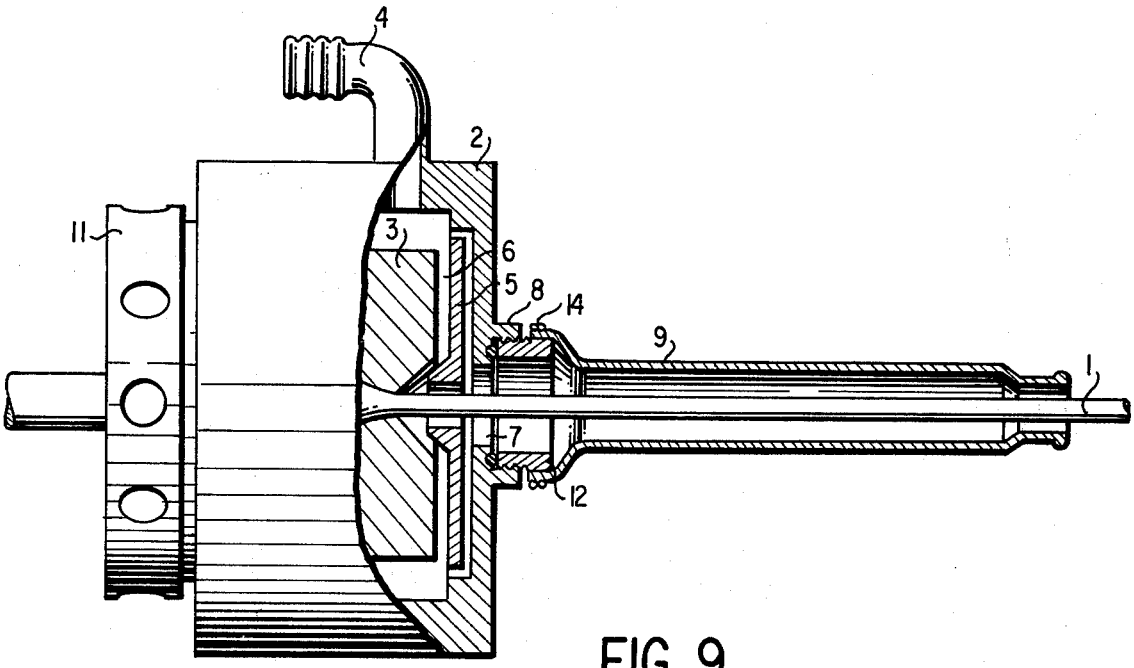

Referring more particularly to FIG. 9, there is shown one example of a device by which the method of the present invention may be practiced. As seen in such FIGURE, a steel wire 1 is drawn through a die 3 which is disposed within a die holder 2. Defined within the upper portion of die holder 2 is an inlet 4 for a cooling medium, such as for example, water whereby the cooling medium from inlet 4 may be introduced into a space or chamber 6 defined between a cooling-medium guide fixture 5 and the rear surface of die 3 so as to thereby forcedly cool the steel wire immediately subsequent to the emergence of the same from die 3. An axially extending attaching portion 8 integrally formed with holder 2 encompasses the exit hole 7 of die holder 2 and a pipe or conduit 9 having a bore of larger diameter than that of the steel wire after the drawing process is affixed to attaching portion 8. The pipe 9 thereby provides the steel wire with a cooling passage of a given length and encompasses steel wire 1 in such a manner as to communicate the interior bore thereof with the cooling passage provided within the die holder 2 whereby the cooling medium from die holder 2 may be introduced into the passage within conduit 9 allowing the continued forced cooling of the steel wire for a given period of time. It should be noted here however, that even if conduit 9 is not utilized, superior cooling may nevertheless be effected as compared with the prior art cooling method due to the presence of the cooling medium within chamber 6.

Turning now to FIG. 6*a*, wherein there is shown one example of the wire drawing die 3, the upper side of die 3 as viewed in the FIGURE corresponding to the forward portion of the die, that is, the wire entrance side, while the lower portion thereof corresponds to the rear or downstream portion of the die, that is, the wire exit side, with a relief portion 3' being formed within the rear portion of the die. FIG. 7*a* shows the guide fixture 5 which is disposed rearwardly of the rear portion of the die as seen in FIG. 9 and is adapted to guide the cooling liquid toward the steel wire 1 which has emerged from the exit aperture of the die. The cross-sectional configuration of fixture 5 may be different from those shown either in FIGS. 7*a* or 7*b*, except for the axial throughhole 5' thereof, and within the examples illustrated in FIG. 7, the fixture has radially extending ridges 5'' upon the forward face thereof whereby the cooling liquid may readily be directed toward and encompass the outer surface of steel wire 1.

Figure 8:
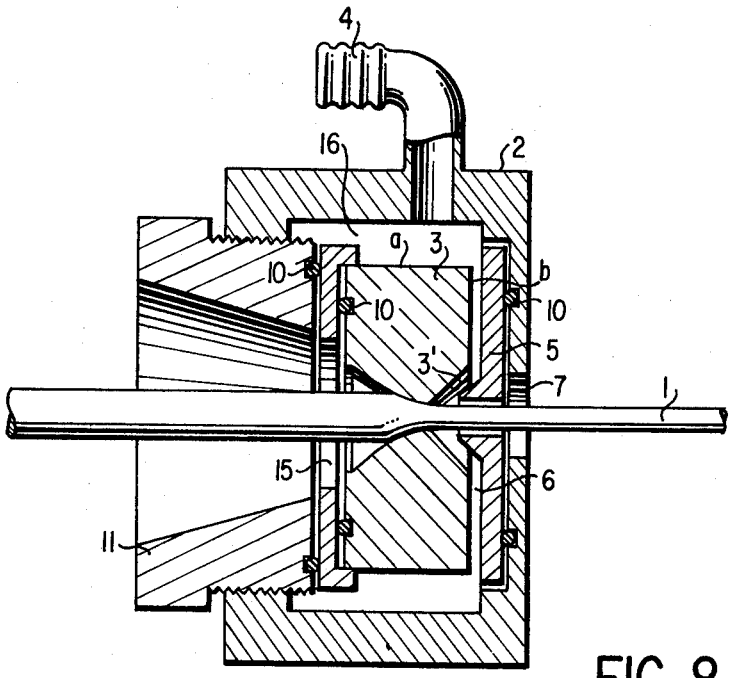
FIGS. 8 and 9 are vertical longitudinal, cross-sectional and partially cross-sectional views, respectively, of a die holder assembly constructed according to the present invention.

Referring now to FIG. 8, there is shown a die assembly which includes a die holder 2 which is provided with cooling medium passage 4, a die 3 disposed within holder 2, a guide fixture 5, facing the rear portion of the die, similar to those fixtures shown within FIG. 7, and a water tight O-ring 10 confined between die holder 2 and the guide fixture 5. Another fixture 15 is located adjacent the forward side of die 3 and is adapted to hold the same while preventing the cooling liquid from flowing out of the forward portion of the die, additional water tight O-rings 10 being interposed between fixture 15 and the forward portion of die 3.

As a result of the foregoing structure, there is provided a passage for the cooling medium which, according to the present invention, comprises two spaces or chambers, one 16 of which is bounded by the outer peripheral portion a of die 3 and the interior face of die holder 2, and another 6 of which communicates with the first chamber 16 and is similarly bounded by the rear portion *b* of die 3, including the relief portion 3' so as to encompass the length of the steel wire 1 extending from the exit of die hole 3'' to the wire exit hole 7 within holder 2, and the forward face of fixture 5. The cooling liquid fed through inlet 4 defined within the upper portion of die holder 2 therefore serves to cool the outer peripheral portion a and the rear portion b of the die, as well as the length of the drawn wire extending to the exit portion of the die holder 2. Furthermore, cooling liquid can be fed by means of a guide fixture as shown in FIG. 7b, instead of the fixture 15, so as to effect cooling of the front face of die 3.

The drawing and cooling steps of the forming process will be described more in detail with particular reference still being made to FIG. 8. A wire 1 is drawn from the left toward the right as viewed in FIG. 8, with a die holder 2 mounted within a die box within a known drawing machine, not shown. During this time, the cooling liquid which is being fed through the inlet 4 cools the outer peripheral surface (a) and the rear portion of the die 3 including the relief portion 3' thereof as well as the length of the wire extending from the die exit to the exit portion of die holder 2 whereby the cooling liquid is then discharged from the exit hole 7 within die holder 2.

In conjunction with the above, there may be defined another space or chamber between the guide fixture 5 and the inner surface of die holder 2 upon the exit side thereof for the purpose of providing an additional flow passage for the cooling liquid and for increasing the flow rate of the cooling liquid, or alternatively, the back pressure of the cooling liquid may be increased in order to in effect attain the above purposes. The cooling liquid may be emitted from the assembly at a position immediately rearwardly or downstream of the exit hole 7 within die holder 2, however, as shown in FIG. 9, the cooling effect may be further enhanced when a considerable length of the steel wire 1 downstream of die holder 2 is cooled with cooling liquid.

More particularly, there is provided an axially extending attaching portion 8 which encompasses the exit hole 7 within die holder 2 and an attachment block 12 is removably threaded into attaching portion 8. A pipe or conduit 9 having a diameter larger than that of the drawn steel wire is secured upon attachment 12 by means of suitable fastening members 14, pipe 9 being made of steel, aluminum, or copper, and thus providing as extended cooling-liquid passage of a given length which communicates with the cooling-liquid passage within die holder 2. In this respect, the liquid is emitted from the other end of pipe or conduit 9, and alternatively, the cooling liquid may be introduced directly into the pipe 9 from a separate source and then discharged in a manner similar to that noted above. In this instance, it is imperative that the cooling liquid within pipe 9 present a positive pressure relative to the atmospheric pressure when the same is introduced from a separate, external source. A cover 11 may also be provided upon the upstream end of die holder 2.

With respect to the particular cooling medium, water would be primarily used as the cooling liquid, and an evaporizable corrosion-preventive agent may be added to the water contained within a separate cooling water reservoir when in circulation so as to thereby prevent corrosion of the steel wires drawn as well as associated portions of the wire drawing machinery. Moreover, with respect to the particular die, as shown within FIG. 6*b*, there may be provided several additional radially extending cooling passages 13 extending between the outer peripheral portion a and the relief portion 3' of die 3, the number of such passages not adversely affecting the strength of the die.

Figure 10:
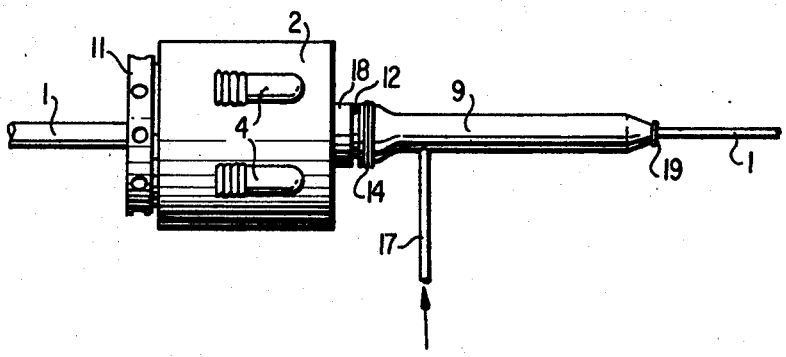
FIG. 10 is a plan view of one embodiment of the cooling apparatus utilized in performing the method of the present invention.

Turning now to FIG. 10 there is shown a plan view of the cooling device assembly having a cooling pipe or conduit 9 in accordance with the present invention for cooling the steel wire immediately subsequent to the egress thereof from the die exit, a die holder 2, cooling liquid inlets 4, a pipe or conduit 17 for introducing cooling liquid directly into pipe 9, and a die holder exit portion 18, the end of pipe 9 opposite its connection to holder portion 18 being open as at 19 for permitting the emergence of wire 1 as the same is drawn from the left toward the right as viewed in FIG. 10 through the die within die holder 2. The pipe 9 may be secured upon an attachment 12 in a simple manner, such as for example, by using a suitable fastening member 14 in water tight relation, therewith, in which respect, attachment 12 may be removably coupled to die holder exit portion 18 by threading the former into the latter. In addition, seals such as O-rings should be provided at several positions, as required, so as to prevent leakage.

Pipe 17 is coupled to pipe 9 for feeding the cooling liquid or water directly therein so as to maintain a positive pressure therewithin relative to atmospheric pressure and thus effect efficient cooling for the drawn steel wire, the cooling liquid of course encompassing the wire within conduit 9. While the cooling water may be discharged from the open end 19 of pipe 9, the open end 19 of pipe may alternatively be covered with a suitable means so as to prevent splashing of the water as well as to maintain good lubrication for the steel wire drawn, the cover or other suitable means may be made of an extensible material, such as for example, rubber. Still further, an additional alternative would encompass the recovery of the cooling liquid which has been discharged whereby the same may be re-used.

A detailed description will now be made of another device by which the method devised according to the present invention may be practiced, particular reference being made to FIG. 11 wherein a cooling pipe 9, partially shown, the major portion thereof having been omitted for convenience and clarity, is secured to a lubricant casing 21, provided within a known wire drawing machine, by means of an attaching flange 22 and bolts, not shown, in such a manner that the die may be readily replaced. The tip or end of pipe 9 disposed toward the die is coupled to the exit portion of the die holder through means of a gland-packing 20 and the pipe 9 is seen to have a diameter larger than that of the steel wire drawn through die 3 whereby cooling water fed through inlet 4 provided within die holder 2 cools the outer peripheral surface of die 3 and is then able to be introduced into the interstice existing between die 3 and spacer 5 so as to thereby cool both the rear portion of the die and the steel wire immediately subsequent to the emergence of the same from die 3.

There is also provided a radially disposed cooling liquid discharge conduit 23 connected with cooling pipe 9 within the vicinity of the open end thereof, and disposed rearwardly or downstream of discharge port 23 is a cooling liquid, air-shielding chamber 29 having a radially disposed compressed air inlet 28 fluidically coupled therewith whereby the compressed air introduced therewithin may shield the cooling liquid which is apt to be introduced into chamber 29 through means of a small axial hole 24 provided within a transverse partition wall 25, the compressed air in turn being discharged through an open mouth piece 27 having a small axial hole 26 through which the drawn wire is led exteriorly of the die assembly. In conjunction with the foregoing it should be noted that the bores or small holes 24 and 26 have suitable interstices provided with respect to the surface of the drawn wire so as to maintain suitable lubrication for the wire.

Figure 11:
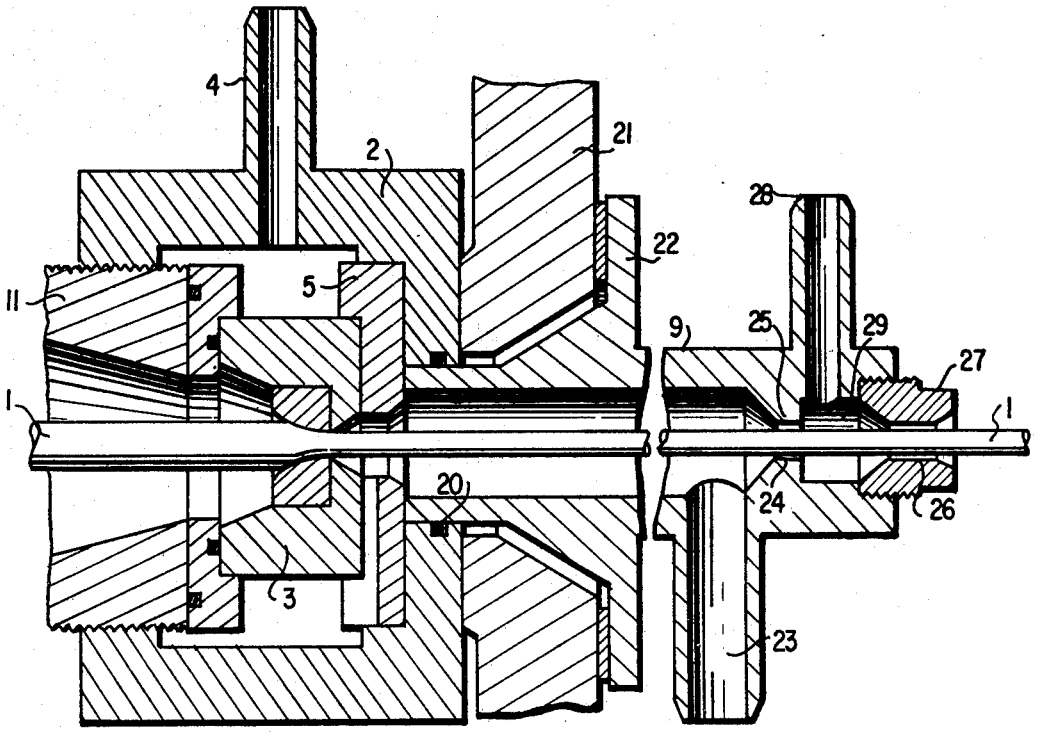
FIGS. 11 and 12 are partial vertical longitudinal cross-sectional views of additional embodiments of the cooling apparatus utilized in performing the method of the present invention.
Figure 12:
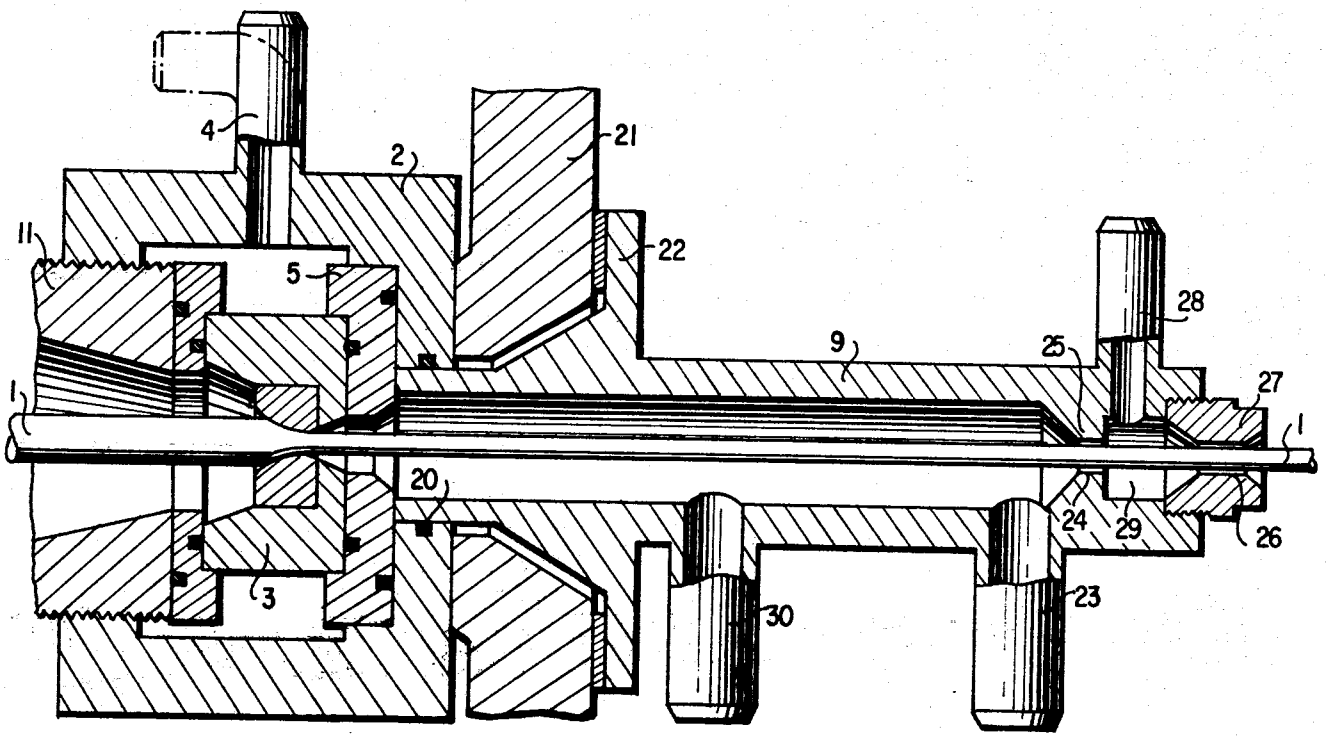
Figure 13:
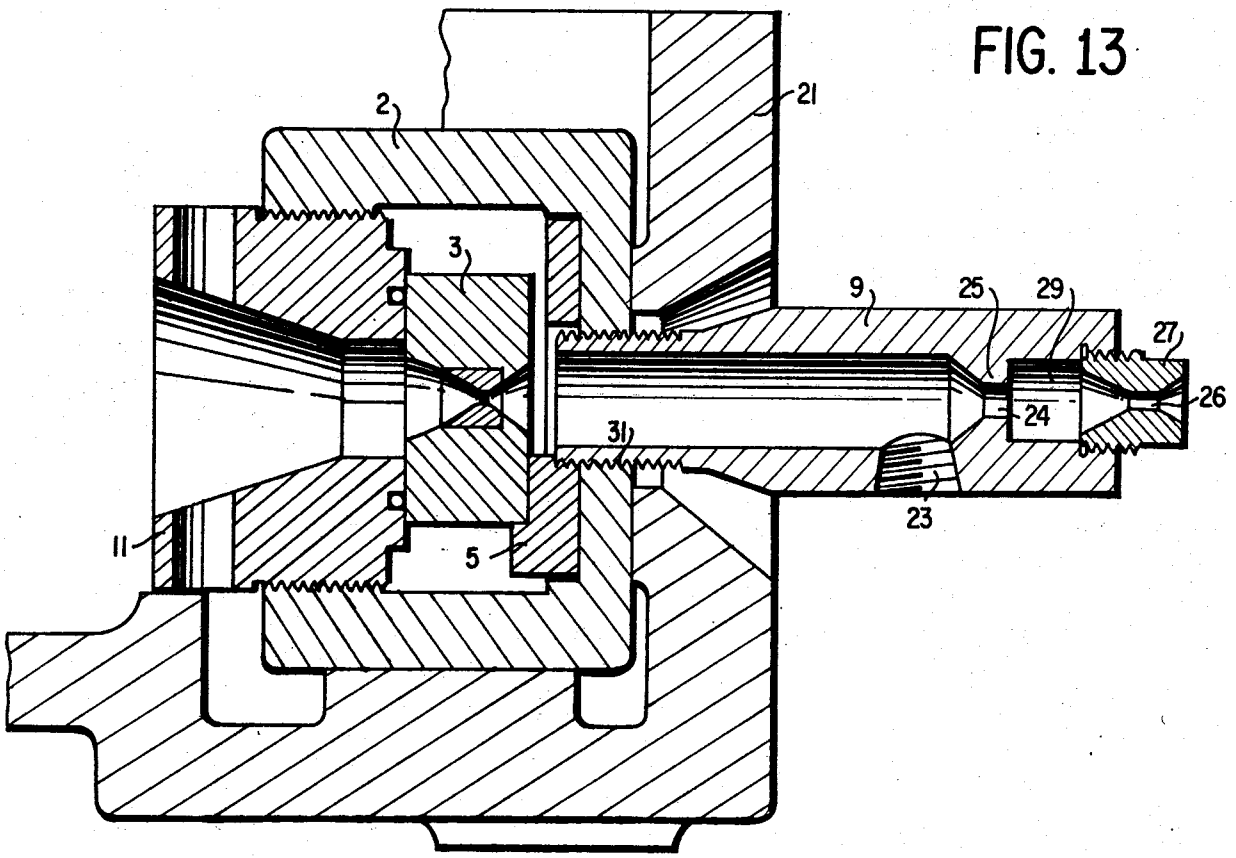
FIG. 13 is a horizontal, longitudinal cross-sectional view of still an additional embodiment of the die and cooling assembly apparatus by which the method according to the present invention may be practiced.

Another embodiment of the present invention is disclosed within FIG. 12 wherein there is provided a water feed pipe 30 for supplying cooling water to pipe 9, in addition to and separately from the cooling water supplied from inlet 4, while the embodiment disclosed within FIG. 13 provides the cooling pipe 9 to be directly threaded into the attaching portion 31 of die holder 2 in lieu of the flanged portion 22 and bolts, not shown, secured to the lubricant casing 21 as shown within the embodiment of FIGS. 11 and 12. However, the embodiments as shown within FIGS. 11 and 12 present the advantage of permitting the removal of the die holder 2 alone when replacing the die.

As is apparent from the foregoing description, cooling liquid fed into pipe 9 encompasses the steel wire which has just emerged from die 3 and which has the highest surface temperature whereby strain-aging embrittlement is most likely to occur. In addition, the cooling liquid having a positive pressure relative to atmospheric pressure is introduced around the wire drawn through the die in a continuous manner so as to effect timely cooling of the same whereby a steel wire having high toughness and which is free from cracking or other defects may be obtained through an accelerated drawing process. Still further, there is provided a cooling-water, air-shielding chamber within the vicinity of the open end of cooling pipe 9, within which compressed air is introduced under a pressure greater than that of the cooling liquid so as to thereby shut-out the cooling liquid from the chamber thereby preventing splashing of the cooling liquid which is being discharged from the discharge port 23 associated with pipe 9. A hose or the like may then be coupled to the discharge port 23 for recovering the cooling water for re-use thereof.

The following examples are illustrative of the aforenoted features of the method devised in accordance with the present invention:

EXAMPLE 1

Tests were conducted upon a sample of steel wire stock of the type SWRH62A, JIS high carbon steel, whose composition was 0.60%C, 0.22%Si, 0.47%Mn, 0.023%P, 0.016%S, 0.03%Cu, 0.02%Ni, 0.03%Cr, and the balance of which was Fe. This steel wire stock was first subjected to lead patenting at a diameter of 5.5 mm, the heating temperature of which was 930°C and the lead temperature was 535°C, then to acid pickling and phosphate coating as pretreatment processing steps, and then to drawing. The drawing schedule was as follows:

| | | | | | |
|---|---|---|---|---|---|
| Diameter | 5.5$\phi$ → | 4.7$\phi$ → | 4.0$\phi$ → | 3.4$\phi$ → | 2.9$\phi$ → 2.5$\phi$ |
| Reduction of area (%) | (27) | (27.5) | (27.6) | (27) | (25.5) |

In this example, cooling was applied to the rear portion of the die, a cooling pipe having a length of 60 mm being used, and the lubricant used was metallic or solid powder soap. The prior art method, wherein only the outer peripheral surface of the die and the inner surface of the blocks are cooled, was compared with the method devised according to the present invention, with respect to the tensile strength and reduction of area properties or characteristics, and the results of such comparison of method are shown in Table 2 below:

TABLE 2

| | Tensile Strength (kg/mm²) | | Reduction of Area (%) | |
|---|---|---|---|---|
| | prior art | present invention | prior art | present invention |
| 5.5ϕ (As lead patented) | 100.3 | 106.2 | 53.5 | 51.7 |
| 2.5ϕ (Drawing Speed 300 m/min.) | 158.2 | 152.7 | 58.2 | 62.0 |
| Difference in tensile strength (between 2.5ϕ and 5.5ϕ) | 57.9 | 46.5 | — | — |

Figure 14:
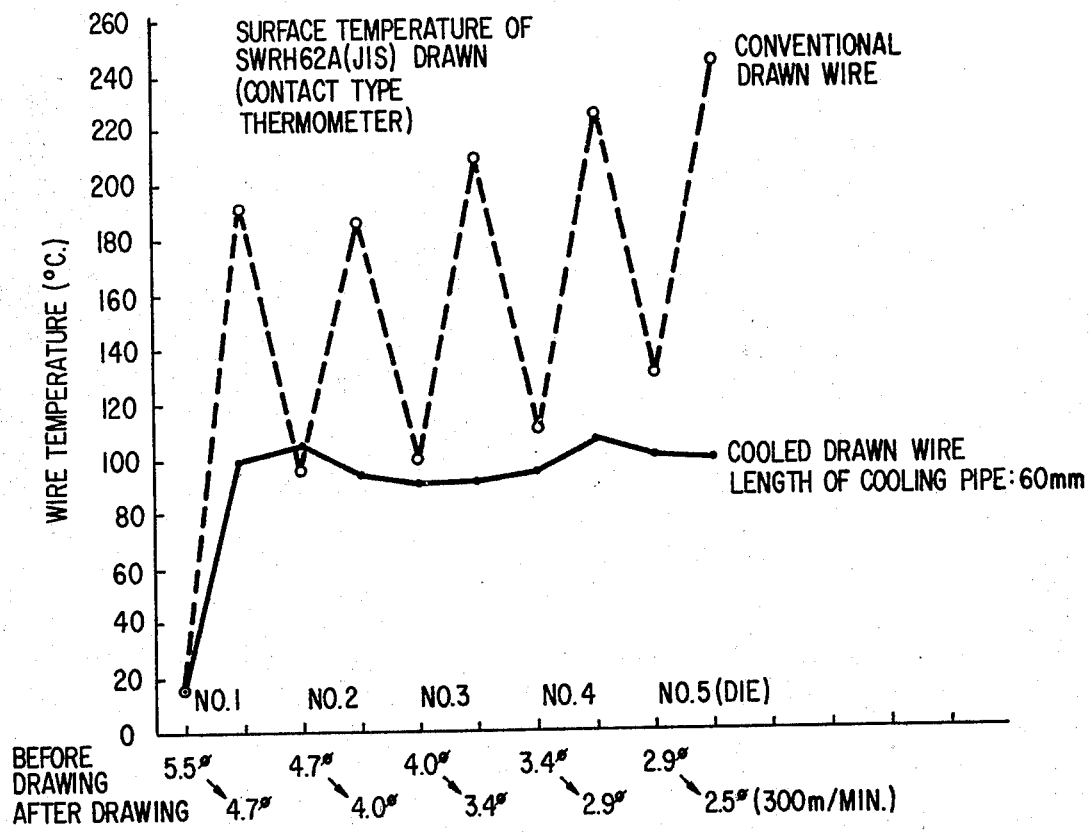
FIGS. 14 and 15 are graphical plots of the wire temperature as a function of drawing speed wherein the cooling effected upon the drawn wire is shown for a conventional method as well as the method of the present invention.

According to the method of the present invention, a lower degree of increase in tensile strength due to work-hardening resulted thus presenting corresponding improved ductility. FIG. 14 shows the changes in temperature at the surface of the steel wires at the time of drawing.

EXAMPLE 2

Tests were conducted upon a steel wire stock of the type SWRH62A wherein 0.03 to 0.06%Al was added and N was fixed by Al. The drawing schedule was as follows:

Diameter 5.6ϕ → 5.05ϕ → 4.4ϕ → 3.8ϕ → 3.3ϕ → 2.9ϕ → 2.55ϕ → 2.24ϕ
Reduction of area (%) (total reduction of area: 84%)

The pretreatment up to the diameter of 5.6ϕ followed the same procedure as was given in connection with that of Example 1. Within this Example 2, cooling pipes having a length of 180 mm were used, and the cooling method practiced by means of the present invention assembly as shown in FIG. 13 was applied only when the steel wire had been drawn to diameters of 3.3ϕ 2.9ϕ and 2.55ϕ. A comparison of the present invention method with the prior art is given in Table 3 below:

TABLE 3

| | Tensile Strength (kg/mm²) | | Reduction of Area (%) | | Cooling by Cooling Water (K cal/min.) | |
|---|---|---|---|---|---|---|
| | Prior Art | Present Invention | Prior Art | Present Invention | Prior Art | Present Invention |
| 5.6ϕ (As lead patented) | 86.3 | 86.5 | 45.5 | 44.6 | — | — |
| 2.55ϕ (Drawing Speed: 385 m/min.) | 146.9 | 145.1 | 36.7 | 45.0 | 8.0 | 82.5 |
| 2.24ϕ (Drawing Speed: 500 m/min.) | 155.6 | 152.7 | 36.3 | 40.1 | — | — |
| Difference in tensile strength (between 5.6ϕ and 2.24ϕ) | 69.3 | 66.2 | — | — | — | — |

Figure 15:
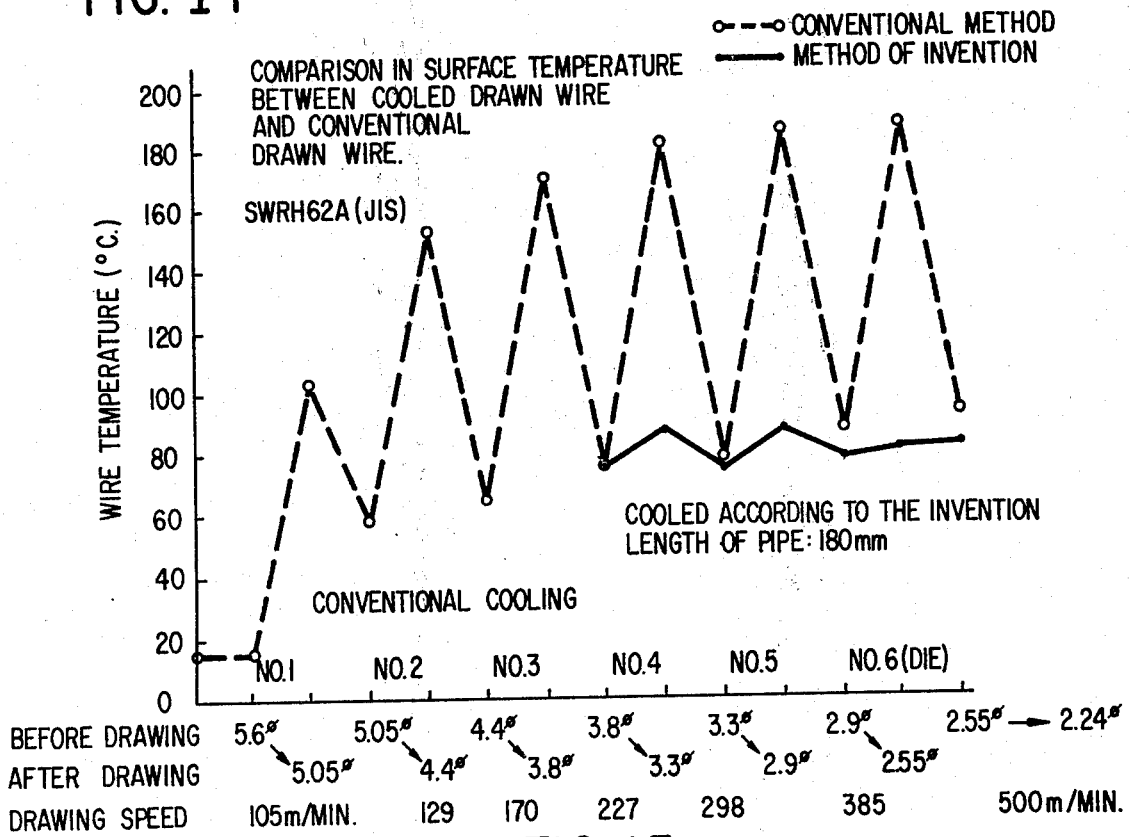

Within this Example 2, the reduction of area was satisfactory and therefore excellent ductility was obtained. FIG. 15 shows the changes in temperature at the surface of the steel wire at the time of drawing. In addition, the reduction of area and torsion values were excellent and thus the desired steel wires were produced.

Obviously, many modifications and variations of the present invention are possible in light of the above teachings. It is to be understood therefore that within the scope of the appended claims the present invention may be practiced otherwise than as specifically described herein.

What is claimed as new and desired to be secured by Letters Patent of the United States is:

1. A method for cooling a steel wire and one or more dies within a dry lubricant drawing system, characterized in that said method comprise the steps of:

providing said wire with dry lubricant prior to the passage thereof through each of said dies and passing said wire through each of said dies under dry lubricant conditions;

drawing a steel wire to a desired dimension, through each of said dies; and immediately bringing a cooling liquid into direct contact with both the rear portion of each of said dies, including a back relief portions thereof, and said steel wire as said wire is passing through and within the vicinity of each of the die exits, in a manner so as to effect the cooling of said wire and each of said dies before the commencement of strain-aging embrittlement within said wire.

2. A method as set forth in claim 1, wherein said cooling is effected by causing said cooling liquid to flow through a passage partly bounded by said rear portion of said die, includng said back relief portion thereof which is continuous with the die bearing portion, whereby said die and the surface portion of said wire may be positively cooled.

3. A method as set forth in claim 2, wherein said passage is also bounded by the front portion of a die casing.

4. A method as set forth in claim 2, wherein said cooling passage includes the interior of a conduit which encompasses said drawn steel wire, said conduit extending downstream or rearwardly from a die holder exit portion along the length of said drawn steel wire.

5. A method as set forth in claim 4, wherein said conduit is formed continuously with said die holder exit portion and in communication with the interiors of said die holder and has a diameter larger than that of said drawn steel wire, whereupon cooling liquid being introduced within the interior of said conduit under a pressure greater than atmospheric, the open end of said conduit as viewed in the advancing direction of said wire serves as a discharge port for said cooling liquid.

6. A method as set forth in claim 5, wherein the open end of said conduit as viewed in the advancing direction of said drawn steel wire is shielded by compressed air so as to prevent said cooling liquid from discharging therefrom, said cooling liquid being discharged from an upstream portion of said conduit.

7. A method as set forth in claim 2, wherein there is provided a guide fixture adapted to guide said cooling liquid to said rear portion of said die, includng the relief portion thereof, as well as to said die exit and said steel wire being drawn rearwardly from said die exit, said fixture being provided thereon with a plurality of radially extending ridges.

8. A method as set forth in claim 3, wherein there is provided a guide fixture adapted to guide said cooling liquid to the forward portion and the peripheral surface of said die.

9. A method as set forth in claim 2, wherein there is provided a plurality of passages within said die in a manner so as to extend from the outer peripheral surface of said die to said rear portion thereof for providing an access for said cooling liquid between said peripheral surface and said rear portion.

10. A method as set forth in claim 2, wherein the temperature of said cooling liquid is maintained below the boiling point of said cooling liquid.

11. A method as set forth in claim 2, wherein a steel wire having a diameter of not more than 13mm is water-cooled within a period of time of one second.

12. A method for cooling a steel wire and one or more dies within a dry lubricant drawing system, which comprises the steps of:

providing said wire with dry lubricant prior to the passage thereof through each of said dies and passing said wire through each of said dies under dry lubricant conditions;

drawing a steel wire to a desired dimension, through each of said dies, immediately bringing a cooling liquid into direct contact with both the rear portion of each of said dies, including the back relief portion which is continuous with the die bearing portion, and said steel wire as said wire is passing through and within the vicinity of each of the die exits, in a manner so as to effect the cooling of said wire and each of said dies to a temperature sufficient to prevent the commencement of strain-aging embrittlement within said wire, wherein said cooling is effected by causing said cooling liquid to flow through a first substantially radial passage partly defined by said rear portions of said dies and a guide fixture which is adapted to guide said cooling liquid to said rear portions of said dies, as well as through a second axially extending passage defined within the interior portion of a tubular conduit which encompasses said drawn wire and which extends downstream or rearwardly, away from a die holder exit portion along the length of said drawn steel wire, said second passageway being in continuous communication with the interior portions of said die holders and therefore a fluidic extension thereof, and having a diameter substantially larger than that of said drawn steel wire, the open end of said conduit, as viewed in the advancing direction of said wire, defining a discharge port for said cooling liquid whereby said cooling liquid is discharged from a downstream portion of said conduit; and maintaining the temperature of said cooling liquid below the boiling point of said cooling liquid.

13. A method as set forth in claim 12, wherein:

said first cooling passage is also defined by the peripheral surface of said die.

14. A method as set forth in claim 13, wherein:

said first cooling passage is also defined between the front portion of a die casing and a guide fixture adapted to guide said cooling liquid to the forward portion and the peripheral surface of said die.

15. A method as set forth in claim 13, wherein:

said cooling liquid is fed to the peripheral surface of said die, passed through said rear portion of said die, and then introduced within the interior of said conduit under a pressure greater than atmospheric pressure; and the open end of said conduit as viewed in the advancing direction of said wire serves as a discharge port for said cooling liquid.

16. A method as set forth in claim 12, wherein said cooling liquid is water.

17. A method as set forth in claim 12, wherein:

there is provided a plurality of passages within said die in a manner so as to extend from the outer peripheral surface of said die to said rear portion thereof for providing an access of said cooling liquid between said peripheral surface and said rear portion.

18. A method as set forth in claim 12, wherein:

said guide fixture positioned within the rearward portion of said die is provided thereon with a plurality of radially extending ridges for guiding said cooling liquid toward said die.

19. A method as set forth in claim 12, wherein:

said open end of said conduit is shielded by compressed air so as to prevent said liquid from discharging therefrom, and said cooling liquid is discharged from an upstream portion of said conduit.

* * * * *